US009828826B2

(12) United States Patent
Bishop et al.

(10) Patent No.: US 9,828,826 B2
(45) **Date of Patent: *Nov. 28, 2017**

(54) WELLBORE ISOLATION SYSTEM WITH COMMUNICATION LINES

(71) Applicants: David S. Bishop, Houston, TX (US); John E. Britt, Houston, TX (US); Kim Tijerina, Houston, TX (US); Kirby Glen Schrader, Magnolia, TX (US); Conner S. George, Houston, TX (US); Marc N. Samuelson, Houston, TX (US); Kelly D. Ireland, Conroe, TX (US); Rockni Van Clief, Houston, CT (US); Christian F. Bayne, Montgomery, TX (US); David A. Bilberry, Houston, TX (US)

(72) Inventors: David S. Bishop, Houston, TX (US); John E. Britt, Houston, TX (US); Kim Tijerina, Houston, TX (US); Kirby Glen Schrader, Magnolia, TX (US); Conner S. George, Houston, TX (US); Marc N. Samuelson, Houston, TX (US); Kelly D. Ireland, Conroe, TX (US); Rockni Van Clief, Houston, CT (US); Christian F. Bayne, Montgomery, TX (US); David A. Bilberry, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/192,460

(22) Filed: Jun. 24, 2016

(65) Prior Publication Data

US 2016/0305214 A1 Oct. 20, 2016

Related U.S. Application Data

(63) Continuation-in-part of application No. 14/328,850, filed on Jul. 11, 2014.

(51) Int. Cl.
*E21B 33/12* (2006.01)
*E21B 34/10* (2006.01)
(Continued)

(52) U.S. Cl.
CPC ..... *E21B 33/12* (2013.01); *E21B 34/10* (2013.01); *E21B 43/08* (2013.01); *E21B 43/14* (2013.01)

(58) Field of Classification Search
CPC ..... E21B 33/12; E21B 33/122; E21B 43/14; E21B 17/028; E21B 23/14; E21B 23/08;
(Continued)

(56) References Cited

U.S. PATENT DOCUMENTS

2002/0020524 A1* 2/2002 Gano ..... E21B 33/12 166/55
2014/0083766 A1* 3/2014 Tips ..... E21B 43/04 175/24

* cited by examiner

*Primary Examiner* — Yong-Suk Ro
(74) *Attorney, Agent, or Firm* — Cantor Colburn LLP

(57) ABSTRACT

An isolation system is disclosed that contains a lower wet connect portion; a central production tubing; an isolation device associated with the central production tubing, and at least one control line. Further at least one control line is associated with the lower wet connect portion and is disposed through an inside diameter of the isolation device. Further method for isolating a lower completion is disclosed that includes conveying an isolation assembly to the lower completion, the isolation assembly including a lower wet connect portion, at least one control line, a central production tubing, and an isolation device, and routing the at least one control line through an inside diameter of the isolation device. Further completion system is disclosed that contains a lower completion system and an isolation system associated with the lower completion system.

20 Claims, 3 Drawing Sheets

(51) Int. Cl.
*E21B 43/14* (2006.01)
*E21B 43/08* (2006.01)

(58) Field of Classification Search
CPC ..... E21B 23/006; E21B 23/00; E21B 17/02;
E21B 43/08; E21B 34/10; E21B 43/12
See application file for complete search history.

WELLBORE ISOLATION SYSTEM WITH COMMUNICATION LINES

CROSS-REFERENCE TO RELATED APPLICATIONS

This application is a continuation-in-part of U.S. patent application Ser. No. 14/328,850, filed Jul. 11, 2014, the entire contents of which are incorporated herein by reference.

BACKGROUND

Field of the Disclosure

This disclosure relates generally to isolation systems deployed in multi-zone production wellbores that include communication lines to facilitate communication with downhole equipment.

Background

Wellbores are drilled in subsurface formations for the production of hydrocarbons (oil and gas). Modern wells can extend to great well depths, often more than 15,000 ft. Hydrocarbons are trapped in various traps or zones in the subsurface formations at different depths. Such zones are referred to as reservoirs or hydrocarbon-bearing formations or production zones and further include lower completion tools to control the flow therein. In a multi-zone well bore, it is often desired to create a flow barrier between the production zones and the upper well completion while still facilitating communication with the lower completion tools, particularly prior to running the upper completion tools.

The disclosure herein provides an isolation assembly that includes at least one communication line, wherein flow paths may be isolated.

SUMMARY

In one aspect, an isolation system is disclosed that in one non-limiting embodiment contains a lower wet connect portion; a central production tubing; an isolation device associated with the central production tubing, and at least one control line, wherein the at least one control line is associated with the lower wet connect portion and is disposed through the isolation device.

In another aspect, a method for isolating a lower completion is disclosed that in one non-limiting embodiment includes conveying an isolation assembly to the lower completion, the isolation assembly including a lower wet connect portion, at least one control line, a central production tubing, and an isolation device, and routing the at least one control line through of the isolation device.

In another aspect, a completion system is disclosed that in one non-limiting embodiment contains a lower completion system; and an isolation system associated with the lower completion system including: a lower wet connect portion; a central production tubing; an isolation device associated with the central production tubing; a concentric valve associated with the central production tubing; and at least one control line associated with the concentric valve, wherein the at least one control line is associated with the lower wet connect portion and the lower completion system and is disposed through the isolation device.

Examples of the more important features of certain embodiments and methods have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
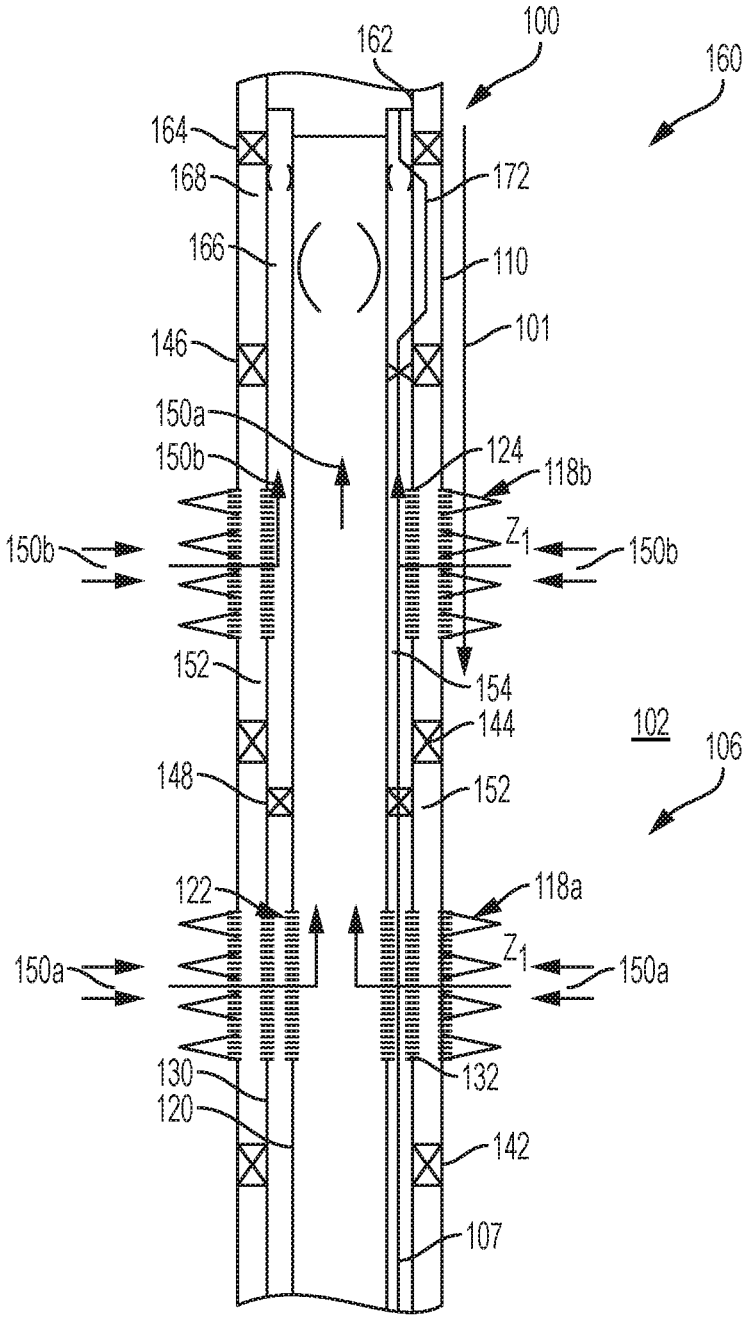
FIG. 1 shows an exemplary cased hole multi-zone wellbore containing a completion system that includes an isolation system and a lower completion system for separately producing fluids from two zones, according to one non-limiting embodiment of the disclosure.

FIG. 1 is a line diagram of a completion system or completion assembly 100 for the production of formation fluids from a multi-zone well, which completion assembly 100 includes an lower completion system 106 and an isolation system 160. The assembly 100 is shown to include a casing 110 deployed in wellbore 101 formed in a formation 102. The formation 102 includes a number of production zones, such zones Z1 and Z2. Perforations 118*a* and 118*b* respectively are formed through the casing 110 into zones Z1 and Z2 to flow the formation fluid 150*a* from zone Z1 into the casing 110 and fluid 150*b* from zone Z2.

The lower completion string 106 includes an inner pipe or tubular 120 and an outer pipe 130. The lower completion system 106 includes a sand screen 132 in outer pipe 130 proximate to the zone Z1 and a sand screen 122 in lower pipe 120 inside and proximate to the sand screen 132. The inner pipe also includes a sand screen 124 in front of the perforation 118*b* in Zone Z2. The lower completion string 106 further includes packers 142 and 144 isolate the annulus 152 between the casing 110 and the outer pipe 130 above and below the perforations 118*a* in zone Z1, while packers 144 and 146 isolate the annulus 152 between the casing 110 and the outer pipe 130 above and below the perforation 118*b* in zone Z2. In addition, lower completion system 106 includes packer 148 to isolate the annulus 154 between the inner pipe 120 and the outer pipe 130 above the zone Z1. In this manner, fluid 150*a* from zone Z1 flows only into the inner pipe 120 through the perforations 118*a*, sand screens 132 and 122 and fluid 150*b* from zone Z2 enters only into the annulus 154 above the zone Z2. Thus, in the string 100, fluid 150*a* from zone Z1 will flow uphole via the inner pipe 120 while fluid 150*b* from Zone Z2 will flow uphole via the annulus 154 between the inner pipe 120 and the outer pipe 130.

Additionally, a communication line 107 may be utilized in lower completion assembly 106 to facilitate monitoring and control of the fluid flow 150*a*, 150*b* that may be present in the lower completion assembly 106.

In an exemplary embodiment, isolation system 160 is associated with lower completion system 106 to isolate and control fluid flows 150*a* and 150*b*. Isolation system 160 includes a wet connect 162, packer 164, a first flow control device 166, a second flow control device 168, and a communication line 172. Isolation system 160 may be located to associate with the upper end of lower completion 106 and interface with upper packer 146. In an exemplary embodiment, a communication line 172 from the isolation system 160 is associated with the communication line 107 of the lower completion assembly 106 to facilitate monitoring and control of the fluid flow and any equipment that may be downhole of the isolation assembly 160. A non-limiting embodiment of a communication line and isolation system for use as the isolation system 160 is described in reference to FIG. 2.

Figure 2:
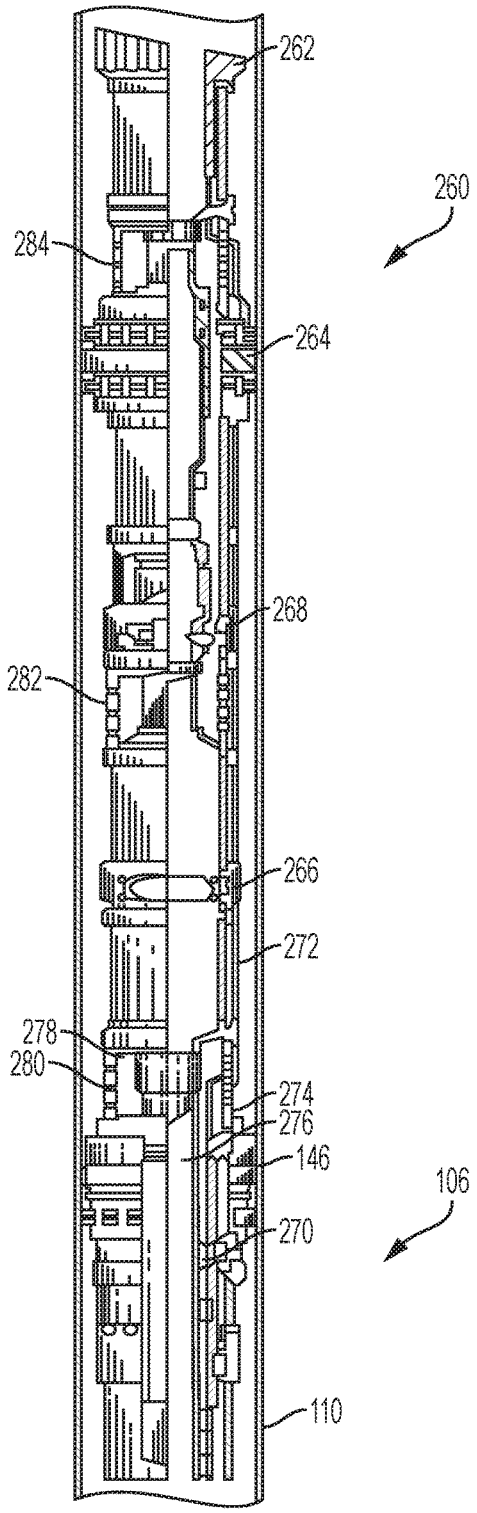
FIG. 2 shows the partial cross-section of a non-limiting embodiment of an isolation system for use in a completion system, including the completion system shown in FIG. 1, for deployment in a multi-zone wellbore, such as wellbore shown in FIG. 1.

FIG. 2 shows a partial cross-section of a non-limiting embodiment of an isolation system 260 for use with a lower completion system, including, but not limited to, lower completion system 106, shown in FIG. 1 for a multi-zone wellbore system 100. The isolation system 260 includes central production tubing 274 that generally interconnects the other elements of isolation system 260. Central production tubing 274 has an inner flow path 276 to receive flow 150*a* from the lower completion system 106 and an outer flow path 278 to receive flow 150*b* from the lower completion system 106. Isolation system 260 further includes a lower half of a wet connect device 262 to facilitate connections to additional downhole equipment. Isolation system 260 also includes a second flow control device 268 that controls fluid flow 150*b* received from the lower completion 106 and a first flow control device 266 that controls fluid flow 150*a* received from the lower completion 106. Below the first flow control device 266 is an isolation seal 270 that may interface with an upper packer 146 of a lower completion system 106. A communication line 272 may be routed through the components of the isolation system 260 to allow communication and control of the lower completion 106 and elements beyond.

In an exemplary embodiment, seal 270 interfaces with an upper packer 146 of a lower completion system 106. Seal 270 may be any type of seal, including, but not limited to an isolating seal 270. Particularly, isolation seal 270 seals the central production tubing 274 against the inside diameter of the upper packer 146. Accordingly, isolation seal 270 provides a leakproof seal between the packer 146 and the central production tubing 274. Further, isolation seal 270 may assist in properly locating lower completion 106. In an exemplary embodiment, isolation seal 270 may be pre-installed and run in with the rest of isolation system 260. In an alternative embodiment, isolation seal 270 may be conveyed separately from the rest of isolation system 260. Communication line 272 may be associated or otherwise connected to a communication line 107 present in lower completion 106. In an exemplary embodiment, communication line 272 is stabbed or otherwise conveyed through isolation seal 270. In an certain embodiments, communication line 272 is routed inside the central production tubing 274 above the isolation seal 270 to be routed beyond the isolation seal 270 to be associated with the communication line 107.

Flow from lower completion 106 may continue upward from packer 146 and isolation seal 270. Inner flow 150*a* is contained by inner flow path 276 of central production tubing 274. Similarly, outer flow 150*b* is contained by outer flow path 278 of central production tubing 274 and casing 110. Inner flow 150*a* flows upward to a first flow control device 266. Outer flow 150*b* flow upward in the annulus around inner flow 150*a*. In an exemplary embodiment, outer flow 150*b* may flow outside of the central production tubing 274 via a first flow crossover 280. Accordingly, the outer flow 150*b* may flow in the annulus between the casing 110 and the central production tubing 274. Similarly, communication line 272 may cross over from within the central production tubing 274 to be routed outside and along the central production tubing 274 at the first flow crossover 280. In an exemplary embodiment, communication line 272 remains disposed outside and along central production tubing 274 until communication line 272 interfaces with isolation device 264.

Inner flow 150*a* in inner flow path 276 of central production tubing 274 is controlled by a first flow valve 266. In an exemplary embodiment, first flow valve 266 is a tubular flow valve. The tubular flow valve may be any valve known in the art. First flow valve 266 interacts with flow 150*a* to allow, restrict, or arrest flow within inner flow path 276. After the fluid flow 150*a* interacts with the first flow valve 266 flow continues upward toward the lower portion of wet connect 262 wherein flow may be directed towards upper completion tools or other additional equipment.

A second flow valve 268 is used to isolate the outer flow 150*b*. In an exemplary embodiment, second flow valve 268 is an annular flow valve. The annular flow valve may be any valve known in the art. Before entering second flow valve 268, in certain embodiments, outer flow 150*b* may flow into a second flow crossover 282 to be within the outer flow 278 path of the central production tubing 274. After crossing over, the outer flow 150*b* may be controlled by second flow valve 268.

The isolation device 264 isolates flow 150*b* allowing second flow valve 268 to control flow 150*b*. Device 264 seals against the casing 110 to locate and isolate isolation system 260. Device 264 may be any isolating device, including but not limited to a packer. Communication line 272 is conveyed through device 264. In an exemplary embodiment, communication line 272 is run through the inside diameter of device 264. In certain embodiments, a feed through device 264 that has a specialized conduit for communication line 272 within the inner diameter of device 264 is used to route communication line 272 through device 264.

A third flow crossover 284 may be used to allow the outer flow 150*b* to flow in the annulus between the central production tubing 274 and the casing 110 beyond the device 264 to allow flow to upper completion tools. Similarly, communication line 272 may cross over from being routed along the central production tubing 274 to being run within the central production tubing 274.

The lower portion of wet connect 262 allows for isolation system 260 to be associated with upper completion tools and communications lines from the surface. The use of a wet connect system allows for communication connections to be made downhole and other harsh environments. The lower portion of wet connect 262 may receive an upper portion of a wet connect connection to locate the upper completion tools, and further facilitate fluid flow and communication between isolation system 260 and the upper completion tools. Communication line 272 may be connected to the lower extent of wet connect 262 to be routed along isolation assembly 260.

Figure 3:
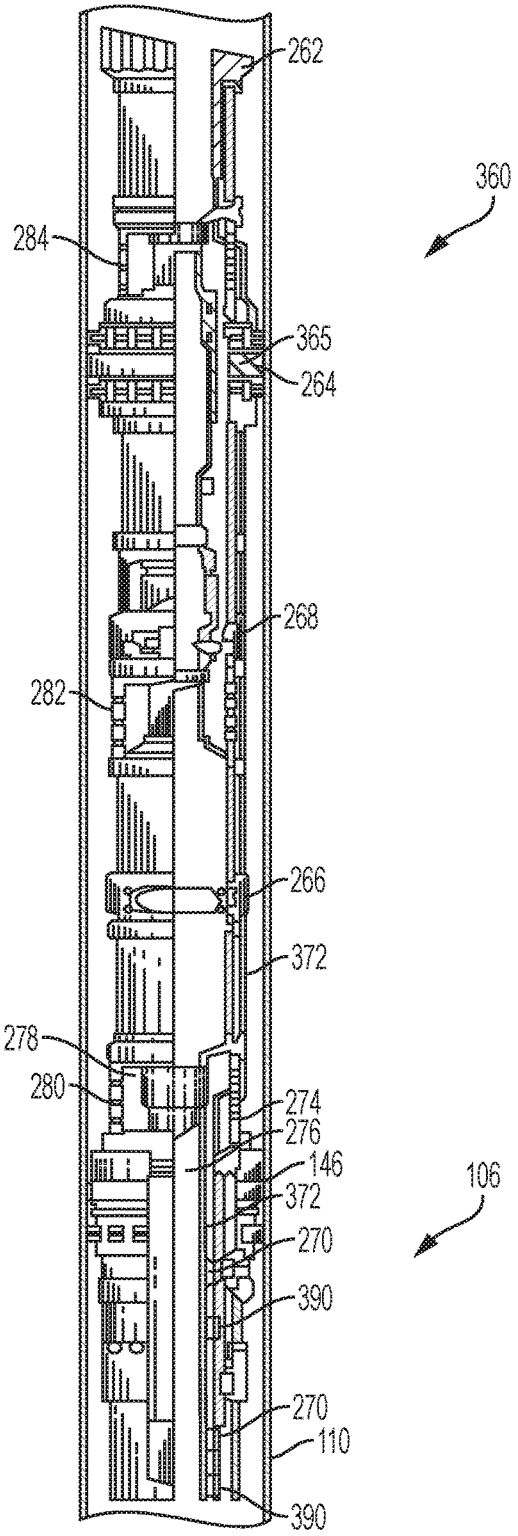
FIG. 3 shows the partial cross-section of a non-limiting embodiment of an isolation system for use in a completion system, including the completion system shown in FIG. 1, for deployment in a multi-zone wellbore, such as wellbore shown in FIG. 1.

Referring to FIG. 3, a partial cross-section of a non-limiting embodiment of an isolation system 360 for use with a lower completion system, including, but not limited to, lower completion system 106, shown in FIG. 1 for a multi-zone wellbore system 100 is shown. In the illustrated embodiment, a control line 372 is routed through components of the isolation system 360 to allow communication and control of the lower completion 106 and elements beyond. In FIG. 3 components of the isolation system 360 may be similar to the described elements of the isolation system 260, wherein similar numerals refer to similar elements.

In the illustrated embodiment, the control line 372 can be any suitable conduit or cable for control purposes, communication purposes, injection purposes, or any combination thereof. The control line 372 can include hydraulic control or flow, a fiber optic line, an electrical cable or any combination thereof. In certain embodiments, the control line 372 can include a chemical injection conduit or any other suitable conduit to allow for fluid injection to a downhole location. In certain embodiments, the control line 372 can be any suitable conduit.

In the illustrated embodiment, the control line 372 may be associated or otherwise connected to a communication line 107 present in lower completion 106. In an exemplary embodiment, control line 372 is stabbed or otherwise conveyed through isolation seal 270. In certain embodiments, control line 372 is routed inside the central production tubing 274 above the isolation seal 270 to be routed beyond the isolation seal 270 to be associated with the communication line 107.

In an exemplary embodiment, control line 372 remains disposed outside and along central production tubing 274 until control line 372 interfaces with isolation device 264. In the illustrated embodiment, the control line 372 is conveyed through device 264. In an exemplary embodiment, control line 372 is run through the inside diameter of device 264. In certain embodiments, a feed through device 264 that has a specialized conduit for control line 372 within the inner diameter of device 264 is used to route control line 372 through device 264. In certain embodiments, the control line 372 is run through a drilled hole 365 through the device 264. In certain embodiments, the drilled hole 365 can be a gun drilled hole through the wall of the mandrel of the device 264. Control line 372 may be connected to the lower extent of wet connect 262 to be routed along isolation assembly 260.

In the illustrated embodiment, the isolation system 360 can include concentric valves 390. The concentric valves 390 any valve known in the art. Concentric valves interact with fluid flow to allow, restrict, or arrest flow into the inner production string 274. Advantageously, the use of concentric valves 390 can allow for the isolation system 360 to provide additional zones of control.

In the illustrated embodiment, the concentric valves 390 are disposed on the inner production string 274 to control flow into the inner production string 274. In certain embodiments, the concentric valves 390 can be controlled by electric, hydraulic, or any other suitable means. In the illustrated embodiment, the concentric valves 390 are actively controlled by the control lines 372.

In certain embodiments, the concentric valves 390 are used in conjunction with additional isolation seals 270. Accordingly, isolation seal 270 can provide a leakproof seal between the concentric valves 390 and the central production tubing 274.

Therefore, in one aspect, an isolation system is disclosed that in one non-limiting embodiment contains a lower wet connect portion; a central production tubing; an isolation device associated with the central production tubing, and at least one control line, wherein the at least one control line is associated with the lower wet connect portion and is disposed through the isolation device. In certain embodiments, the control line is disposed through an inside diameter of the isolation device. In certain embodiments, the control line is disposed through a drilled hole of the isolation device. In certain embodiments, the at least one control line includes a hydraulic line. In certain embodiments, the at least one control line includes a fiber optic line. In certain embodiments, the at least one control line includes an electrical cable. In certain embodiments, the at least one control line includes an injection conduit. In certain embodiments, the injection conduit is a chemical injection conduit. In certain embodiments, the system further includes a concentric valve associated with the central production tubing. In certain embodiments, the concentric valve is an electronically controlled concentric valve. In certain embodiments, the concentric valve is a hydraulically controlled concentric valve. In certain embodiments, the concentric valve is operatively coupled the at least one control line. In certain embodiments, the concentric valve controls flow into the central production tubing.

In another aspect, a method for isolating a lower completion is disclosed that in one non-limiting embodiment includes conveying an isolation assembly to the lower completion, the isolation assembly including a lower wet connect portion, at least one control line, a central production tubing, and an isolation device, and routing the at least one control line through the isolation device. In certain embodiments, the method further includes routing the at least one control line through an inside diameter of the isolation device. In certain embodiments, the method further includes drilling a hole through the isolation device, and routing the control line through the drilled hole of the isolation device. In certain embodiments, the at least one control line includes a hydraulic line. In certain embodiments, the at least one control line includes a fiber optic line. In certain embodiments, the at least one control line includes an electrical cable. In certain embodiments, the at least one control line includes an injection conduit. In certain embodiments, the method further includes selectively providing a flow to the central production tubing via a concentric valve; and selectively engaging the concentric valve via the at least one control line. In certain embodiments, the concentric valve is an electronically controlled concentric valve. In certain embodiments, the concentric valve is a hydraulically controlled concentric valve.

In another aspect, a completion system is disclosed that in one non-limiting embodiment contains a lower completion system; and an isolation system associated with the lower completion system including: a lower wet connect portion; a central production tubing; an isolation device associated with the central production tubing; a concentric valve associated with the central production tubing; and at least one control line associated with the concentric valve, wherein the at least one control line is associated with the lower wet connect portion and the lower completion system and is disposed through the isolation device.

The invention claimed is:

1. An isolation system comprising:

a lower wet connect portion;

a central production tubing;

a fluid crossover associated with the central production tubing;

an isolation device associated with the central production tubing; and a control line, wherein the control line is associated with the lower wet connect portion and is disposed through the isolation device, wherein the control line crosses over from within the central production tubing to be along the central production tubing.

2. The isolation system of claim 1, wherein the control line is disposed through an inside diameter of the isolation device.

3. The isolation device of claim 1, wherein the control line is disposed through a drilled hole of the isolation device.

4. The isolation system of claim 1, wherein the control line includes a hydraulic line.

5. The isolation system of claim 1, wherein the control line includes a fiber optic line.

6. The isolation system of claim 1, wherein the control line includes an electrical cable.

7. The isolation system of claim 1, wherein the control line includes an injection conduit.

8. The isolation system of claim 7, wherein the injection conduit is a chemical injection conduit.

9. The isolation system of claim 1, further comprising a concentric valve associated with the central production tubing.

10. The isolation system of claim 9, wherein the concentric valve is operatively coupled the control line.

11. The isolation system of claim 9, wherein the concentric valve controls flow into the central production tubing.

12. A method for isolating a lower completion, the method comprising:

conveying an isolation assembly to the lower completion, the isolation assembly including a lower wet connect portion, a control line, a central production tubing, an isolation device, and a fluid crossover associated with the central production tubing; and routing the control line through the isolation device, wherein the control line crosses over from within the central production tubing to be along the central production tubing.

13. The method of claim 12, further comprising routing the control line through an inside diameter of the isolation device.

14. The method of claim 12, further comprising:

drilling a hole through the isolation device; and routing the control line through the drilled hole of the isolation device.

15. The method of claim 12, wherein the control line includes a hydraulic line.

16. The method of claim 12, wherein the control line includes a fiber optic line.

17. The method of claim 12, wherein the control line includes an electrical cable.

18. The method of claim 12, wherein the control line includes an injection conduit.

19. The method of claim 12, further comprising:

selectively providing a flow to the central production tubing via a concentric valve; and selectively engaging the concentric valve via the control line.

20. A completion system comprising:

a lower completion system; and an isolation system associated with the lower completion system including:

a lower wet connect portion;

a central production tubing;

a fluid crossover associated with the central production tubing;

an isolation device associated with the central production tubing;

a concentric valve associated with the central production tubing; and a control line associated with the concentric valve, wherein the control line is associated with the lower wet connect portion and the lower completion system and is disposed through the isolation device, wherein the control line crosses over from within the central production tubing to be along the central production tubing.

* * * * *